United States Patent [19]

Krasko et al.

[11] Patent Number: 5,057,743

[45] Date of Patent: Oct. 15, 1991

[54] METAL HALIDE DISCHARGE LAMP WITH IMPROVED COLOR RENDERING PROPERTIES

[75] Inventors: Zeya K. Krasko, Beverly; William M. Keeffe, Rockport, both of Mass.

[73] Assignee: GTE Products Corporation, Danvers, Mass.

[21] Appl. No.: 682,396

[22] Filed: Apr. 4, 1991

Related U.S. Application Data

[63] Continuation of Ser. No. 243,370, Sep. 12, 1988, abandoned.

[51] Int. Cl.[5] ..... H01J 17/20; H01J 61/20

[52] U.S. Cl. ..... 313/639; 313/641

[58] Field of Search ..... 313/639, 640, 641, 642

[56] References Cited

U.S. PATENT DOCUMENTS

| | | | |
|---|---|---|---|
| 3,979,624 | 9/1976 | Liu et al. | 313/639 X |
| 4,053,805 | 10/1977 | Scholz | 313/229 |
| 4,247,798 | 1/1981 | Howe et al. | 313/642 |
| 4,709,184 | 11/1987 | Keeffe et al. | 313/639 X |
| 4,766,348 | 8/1988 | Englishe et al. | 313/641 X |

FOREIGN PATENT DOCUMENTS 1533345 11/1978 United Kingdom .

OTHER PUBLICATIONS

European Pat. Appln. 0 173 235, Keeffe et al., "Low Wattage Metal Halide Lamp", pub. Mar. 5, 1986.

European Pat. Appln. 0 134 426, George J. English, "Single-Ended Metal Halide Discharge Lamp With Minimal Colour Separation", pub. Mar. 20, 1985.

European Pat. Appln. 0 210 626, Gilbert H. Reiling, "Metallic Halide Electric Discharge Lamps", pub. Feb. 4, 1987.

*Primary Examiner*—Sandra L. O'Shea

*Attorney, Agent, or Firm*—Martha Ann Finnegan; Robert E. Walter

[57] ABSTRACT

A low wattage metal halide lamp having improved CRI is disclosed. The low wattage metal halide discharge lamp of the present invention comprises an outer sealed glass envelope; a pair of electrical conductors sealed into and passing through the glass envelope; an arc tube disposed within the outer glass envelope, the arc tube including a pair of spaced electrodes therein with the electrodes being electrically connected to the electrical conductors such that one electrode is electrically connected to one electrical conductor; a chemical fill disposed within the arc tube, the chemical fill comprising mercury, scandium metal, sodium iodide, scandium iodide, lithium iodide, and a starting gas; and a support structure disposed within the outer glass envelope to support the arc tube therein, the support structure being electrically isolated from the electrical circuit of the lamp.

17 Claims, 3 Drawing Sheets

METAL HALIDE DISCHARGE LAMP WITH IMPROVED COLOR RENDERING PROPERTIES

This is a continuation of copending application Ser. No. 07/243,370, filed on Sept. 12, 1988, now abandoned.

TECHNICAL FIELD OF THE INVENTION

The present invention relates to high intensity discharge lamps and more particularly metal halide discharge lamps having warm color, high luminous efficacy, and good color rendering properties.

BACKGROUND OF THE INVENTION

Metal halide lamps of the intermediate and high wattage variety, e.g., 175 to 1500 watts, provide efficacy, color temperature, and a color rendering index (CRI) which meets most higher wattage commercial lighting needs.

Heretofore available low wattage metal halide lamps, e.g., less than 175 watts, however, produce light of a lower CRI than the intermediate and higher wattage variety metal halide discharge lamps. While low wattage metal halide lamps having good efficacy and warm color temperature have been disclosed, such lamps typically have a lower CRI than is desirable for many commercial lighting applications, i.e., such lamps have a CRI of 65 or less. See, for example, U.S. Pat No. 4,709,184 issued to Keeffe et al. on Nov. 24, 1987, entitled Low Wattage Metal Halide Lamp. As a result of their lower CRI, these lamps are not suitable for use in low wattage commercial lighting applications requiring a CRI of about 70 or higher.

SUMMARY OF THE INVENTION

In accordance with the present invention, there is provided a low wattage metal halide lamp having improved CRI. The low wattage metal halide discharge lamp of the present invention comprises an outer sealed glass envelope; a pair of electrical conductors sealed into and passing through the glass envelope; an arc tube disposed within the outer glass envelope, the arc tube including a pair of spaced electrodes therein with the electrodes being electrically connected to the electrical conductors; a chemical fill disposed within the arc tube, the chemical fill comprising mercury, scandium metal, sodium iodide, scandium iodide, lithium iodide, and a starting gas; and a support structure disposed within the outer glass envelope to support the arc tube therein, the support structure being electrically isolated from the electrical circuit of the lamp.

For a better understanding of the present invention, together with other and further advantages and capabilities thereof, reference is made to the following in conjunction with the accompanying drawings.

DISCLOSURE OF THE INVENTION

The present invention is directed to a low wattage metal halide lamp having improved CRI. The low wattage metal halide discharge lamp of the present invention comprises an outer sealed glass envelope; a pair of electrical conductors sealed into and passing through the glass envelope; an arc tube disposed within the outer glass envelope, the arc tube including a pair of spaced electrodes therein with the electrodes being electrically connected to the electrical conductors such that one electrode is electrically connected to one electrical conductor; a chemical fill disposed within the arc tube, the chemical fill comprising mercury, scandium metal, sodium iodide, scandium iodide, lithium iodide, and a starting gas; and a support structure disposed within the outer glass envelope to support the arc tube therein, the support structure being electrically isolated from the electrical circuit of the lamp.

Figure 1:
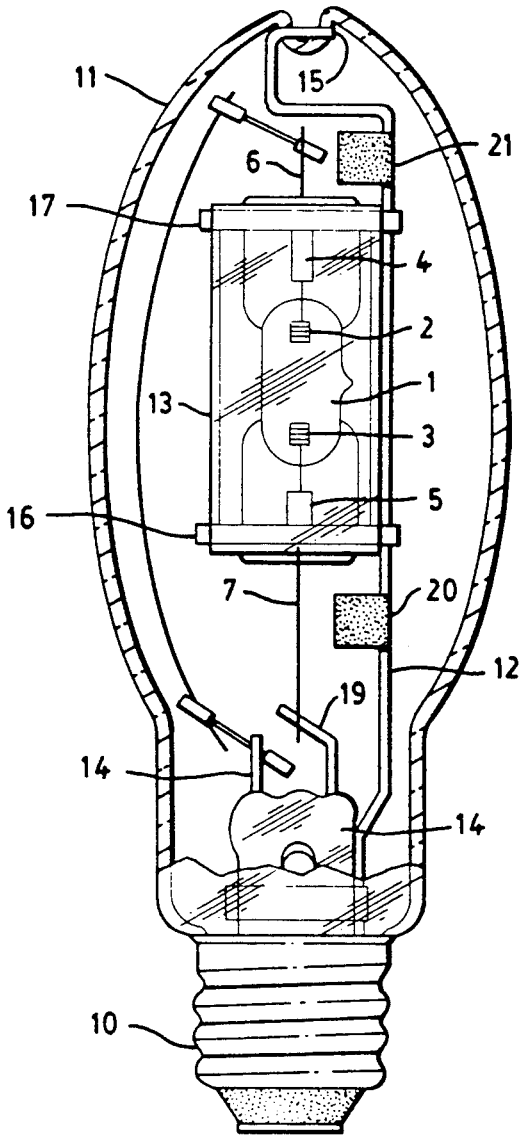
FIGURE 1 is a cross-sectional view of a metal halide lamp made in accordance with this invention.

Referring to FIG. 1 of the drawings, there is shown an example of a preferred embodiment of a lamp in accordance with the present invention. The illustrated lamp includes a quartz discharge tube 1 (also referred to herein as "arc tube") disposed within an outer sealed glass envelope 11. The outer envelope is most preferably evacuated, although the outer envelope of a lamp of the present invention need not be evacuated. The outer envelope 11 is hermetically sealed to a glass stem member 14 having an external base member 10 affixed thereto. A pair of electrical conductors 18 and 19 are sealed into and pass through the stem member 14 and provide access for energization of the discharge lamp by an external source (not shown).

Within the outer envelope 11, a support member 12 is secured to the glass stem member 14 and extends substantially parallel to the longitudinal axis of the lamp and forms a circular configuration 15 near the upper portion of the envelope 11. The circular configuration 15 in conjunction with a dimpled upper portion of the envelope 11 tends to maintain the support structure 12 in proper alignment and resistant to deformation caused by external shock.

A radiating shield 13 is supported from the support structure 12 by means of a first strap member 16 and a second strap member 17. The first and second strap members 16 and 17 are welded to the support member 12 so as to extend therefrom in a direction normal to the longitudinal axis and the direction of the support member 12. The first and second strap members 16 and 17 are spaced apart from each other along the longitudinal axis of the lamp by a distance selected according to the length dimension of a radiating shield 13 so as to provide maximum support therefor.

Within the radiating shield 13 is the discharge tube 1. The discharge tube 1 has a pinch seal at each end thereof. A pair of electrodes 2 and 3 are sealed into the pinch seals of the discharge tube and project into the interior of the discharge tube 1. The electrodes are connected to metal foil members 4 and 5, preferably comprising molybdenum, which are sealed into the press seals. Electrical conductors 6 and 7 are attached to the foil members 4 and 5 and extend outwardly from the press seals. Electrical conductors 6 and 7 are in electrical connection with the first pair of electrical conductors 18 and 19 projecting from the glass stem member 14. A pair of getters 20 and 21 are affixed to the support structure 12 and serve to provide and maintain the vacuum within the evacuated outer envelope 11 in accordance with a most preferred embodiment of the invention. The discharge tube for use in a 100 watt size lamp, for example, has an internal diameter of 10 mm and an arc length of 14 mm.

A single ended design (shown in FIG. 1) with a mogul type base, e.g., an E27 screw base, facilitates universal lamp operation with the full output rating in all burning positions and a life rating of 10,000 hours. The lamp may alternatively have a double-ended configuration (not shown) with a recessed single-contact base.

As shown in FIG. 1, the support structure 12 comprises an electrically conductive "floating-frame", which means that the frame is electrically isolated from the lamp's circuit. As set forth in the foregoing description of FIG. 1, the frame 12 also supports the radiation shield 13 which surrounds the discharge tube 1. Such radiation shield is typically a quartz sleeve which can be open at one or both ends. When an end is closed it typically has a domed configuration.

The "floating-frame" structure design is used to control the sodium loss from the arc tube fill by interrupting the electrical circuit between the frame and electrical conductors, arc tube electrodes, and external power source (not shown). The "floating-frame" structure provides electrical isolation between the radiation shield/arc tube support structure and the external circuit, resulting in the frame and shield floating at a positive potential thereby reversing the sodium electrolysis process. The features and advantages of the "floating-frame" structure are described in more complete detail in co-pending U.S. Pat. Application Ser. No. 814,140 of Robert S. White and James C. Morris, filed 27 Dec. 1985, for "Low Wattage Metal Halide Discharge Lamp", which issued as U.S. Pat. No. 4,963,790 on 16 Oct. 1990, and assigned to the Assignee of the present application, which application is hereby incorporated herein by reference.

In accordance with the present invention it has been found that the "floating-frame" design permits the inclusion of lithium iodide in the chemical fill. It is the inclusion of the lithium iodide additive in the fill in the specified amounts which advantageously has been found to provide a low wattage metal halide type lamp having a color rendering index of at least 70, which has been heretofore unachievable by this low wattage type lamp.

As shown in FIG. 1 and briefly described above, a preferred embodiment of the lamp of the present invention includes a transparent radiation shield 13 of fused quartz which surrounds the arc tube (to capture and return thermal radiation to the arc tube) and the radiation shield is immersed in vacuum (to eliminate heat conduction losses from the shield). The diameter and length of the radiation shield are chosen with respect to the arc tube dimensions to achieve the optimal radiation redistribution resulting in uniform arc tube wall temperatures. See, for example, U.S. Pat. Application Ser. No. 185,755, filed Apr. 25, 1988, which issued on Aug. 22, 1989, as U.S. Pat. No. 4,859,899, the disclosure of which is hereby incorporated herein by reference.

The discharge tube 1 contains a chemical fill which is at least partially vaporized during lamp operation. The chemical fill comprises an inert starting gas, mercury, scandium metal, and a mixture of sodium iodide, scandium iodide, and lithium iodide.

For a low wattage metal halide discharge lamp in accordance having a lamp wattage less than 175 watts, e.g., 40 to 150 watts, the scandium metal weight dosage is preferably from about 90 to 110 micrograms per cubic centimeter of arc tube volume.

The mercury dosage in the chemical fill of a lamp in accordance with the present invention is preferably determined in accordance with the formula:

$$N(Hg)\ (mg/cm^3)=7.7D^{1/7}$$

wherein D is the arc tube diameter in millimeters.

Preferably, the molar ratio of sodium iodide to scandium iodide in the chemical fill is in the range of about 20:1 to 28:1 in order to obtain a desired color temperature and high luminous efficacy. See U.S. Pat. No. 4,709,184, the disclosure of which is hereby incorporated herein by reference.

The chemical fill included in the lamp of the present invention further includes a controlled amount of lithium iodide. The addition of lithium iodide has advantageously been found to significantly increase the lamp color rendering index (CRI) without detriment to the lamp luminous efficacy and other lamp parameters.

Figure 2:
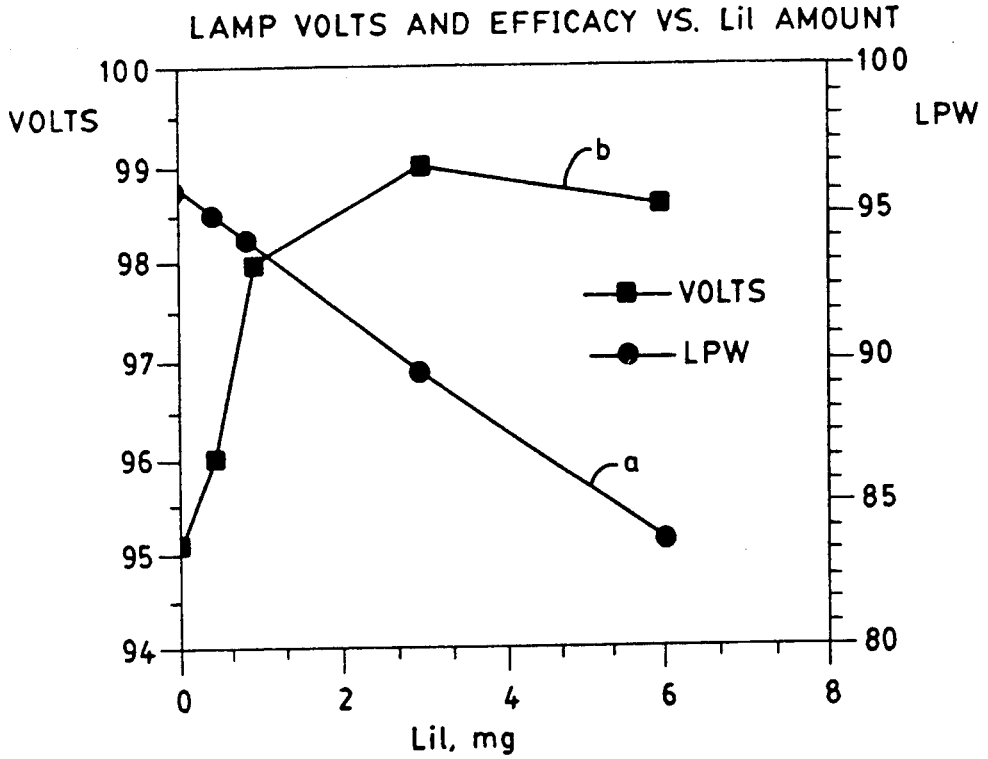
FIG. 2 graphically represents lamp voltage and efficacy as a function of the amount of lithium iodide additive included in the fill of a lamp in accordance with the present invention.

FIG. 2 shows lamp voltage and efficacy as a function of the amount of lithium iodide included in the chemical fill of a lamp in accordance with the present invention. The data set forth in FIG. 2 was obtained using a 100 watt lamp having a configuration similar to that shown in FIG. 1 and including a quartz arc tube having an internal diameter of 10 mm and an arc length of 14 mm. The amount of lithium iodide was varied from 0.5 to 6.0 milligrams. The fill otherwise comprised 13 mg mercury, 0.13 mg scandium metal, 10.7 mg sodium iodide, 1.3 mg scandium iodide, and 100 torr of argon starting gas. These amounts of lithium iodide, sodium iodide, and scandium iodide correspond to a molar ratio of alkali metal iodides (lithium iodide plus sodium iodide) to scandium iodide from about 27:1 to about 40:1. Curve a of FIG. 2 shows that while luminous efficacy linearly decreases with the increase of LiI amount, the operating voltage increases (see Curve b).

Figure 3:
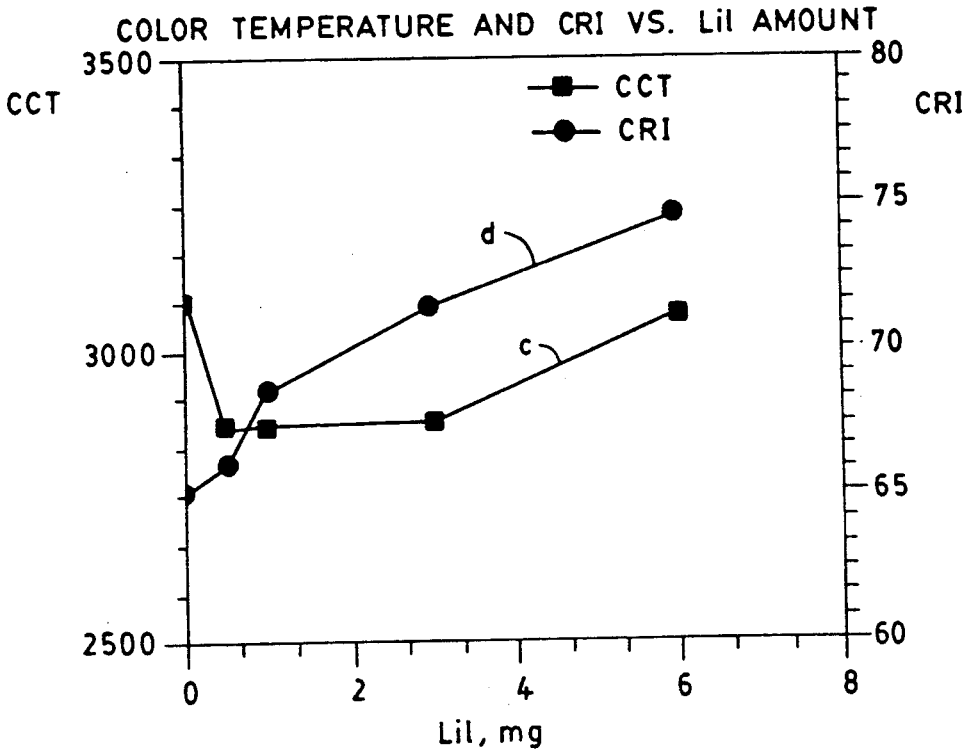
FIG. 3 graphically represents Color Temperature (CCT) and Color Rendering Index (CRI) as a function of the amount of lithium iodide additive included in the fill of a lamp in accordance with the present invention.

In FIG. 3, the Color Temperature (Curve c) and CRI (Curve d) is shown as a function of the amount of lithium iodide. The lamps used to generate the results shown in FIG. 3 are the same lamps which were described above in connection with FIG. 2. The color temperature remains close to 3000±100° K. Most advantageously, CRI increases from about 65 for a lamp including no lithium iodide in the chemical fill to about 74.5, for a lamp including 6 mg lithium iodide in its chemical fill. Preferably, the amount of LiI included in the chemical fill of the lamp of the present invention is about 3–5 mg per 1.3 cubic centimeters, i.e., about 2–4 mg/cm . Such lamps are characterized by a CRI greater than about 70 and a lumen per watt (LPW) value of about 90.

Most preferably, the amount of lithium iodide (LiI) in the chemical fill of the lamp of the present invention is about 4 mg per 1.3 cubic centimeters, i.e., about 3 mg/cm$^3$. Such lamps are characterized by an LPW value of about 91 CRI figure of about 72, and a color temperature of about 3000K.

The unexpected increase in lamp operating voltage for lamps of the present invention (see FIG. 2), i.e., an approximately 5 volts increase, in contrast to lamps having fills containing no LiI, is very beneficial. The higher the contribution of metal halide additive to the lamp operating voltage, the lower the mercury pressure necessary to provide for the given lamp voltage. Such reduction in the mercury pressure necessary for lamp operation makes the lamp safer and more reliable.

The lamp improvement in color rendering properties obtained with the addition of LiI to the NaI and $ScI_3$ metal halide additives of the fill mixture is very important because it provides a new commercial application and market for low wattage type metal halide lamps, e.g., lighting applications requiring a Color Rendering Index greater than or equal to 70, such as Class II installations in Europe.

The composition of the chemical fill of the metal halide lamp of the present invention in combination with the arc tube wall loading level and the floating mount design provides a lamp for which the color shift is least sensitive to design deviations or aging effects. A preferred wall loading level for a low wattage metal halide discharge lamp of the present invention is in the range of about 14 to 17 watts/$cm^2$.

Figure 4:
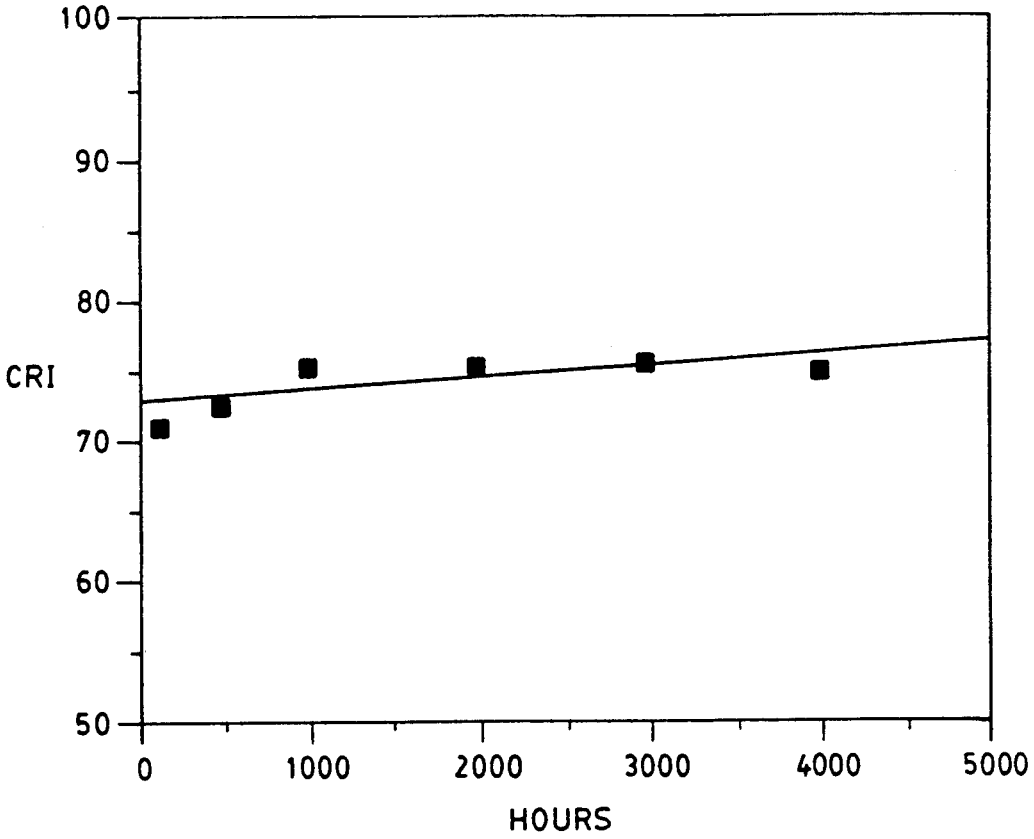
FIG. 4 shows Color Rendering Index (CRI) as a function of hours of illumination time (in hours) for lamps of the present invention.

The color rendering index is plotted over lamp life (in hours) in FIG. 4 showing that the color quality remains relatively constant as the lamp ages. The lamps used to obtain the data included in FIG. 10 were similar to that shown in FIG. 1 and described above. The chemical fill of the lamps used to generate the data of FIG. 4, in each instance, included $NaI+ScI_3+LiI+Hg+Sc$ and argon gas in approximately the same amounts described for the lamps used in FIG. 2. It is to be noted that the CRI of these lamps increases from about 70 to about 75 during the first one thousand hours of lamp operation.

The lamp of the invention will provide equal luminous efficacy in both vertical and horizontal burning positions. The lamp of the invention will further provide uniform color constancy in all burning positions, allowing use of the lamp in all burning positions without sacrificing any of lamp performance. The lamp of the present invention will provide the still further advantage of providing lamp-to-lamp color uniformity over life.

While there has been shown and described what at present is considered the preferred embodiment of this invention, it will be apparent to those skilled in the art that various changes and modifications may be made therein without departing from the invention as defined by the appended claims.

WHAT IS CLAIMED IS:

1. A low wattage metal halide discharge lamp comprising:

an outer sealed glass envelope;

a pair of electrical conductors sealed into and passing through the glass envelope;

an arc tube disposed within the outer glass envelope, the arc tube including a pair of spaced electrodes therein with the electrodes being electrically connected to the electrical conductors such that one electrode is electrically connected to one electrical conductor;

a chemical fill disposed within the arc tube, the chemical fill comprising mercury, scandium metal, sodium iodide, scandium iodide, lithium iodide, and a starting gas; and a support structure disposed within the outer glass envelope to support the arc tube therein, the support structure being electrically isolated from the electrical circuit of the lamp.

2. A low wattage metal halide discharge lamp in accordance with claim 1 wherein said lamp further comprises a radiation shield supported from the support structure such that it surrounds the arc tube.

3. A low wattage metal halide discharge lamp in accordance with claim 1 wherein said chemical fill includes sodium iodide and scandium iodide in a molar ratio of from about 20:1 to about 28:1, respectively.

4. A low wattage metal halide discharge lamp in accordance with claim 3 wherein said chemical fill includes lithium iodide in a molar amount such that the molar ratio of alkali metal iodides to scandium iodide is from about 27:1 to about 40:1.

5. A low wattage metal halide discharge lamp in accordance with claim 1 wherein said chemical fill includes sodium iodide, lithium iodide, and scandium iodide in molar amounts such that the molar ratio of (sodium iodide plus lithium iodide) to scandium iodide is from about 27:1 to about 40:1.

6. A low wattage metal halide discharge lamp in accordance with claim 1 wherein said lamp has a wattage of 40 to 150 watts.

7. A low wattage metal halide discharge lamp in accordance with claim 6 wherein said arc tube has a volume of 0.3–2.2 $cm^3$.

8. A low wattage metal halide discharge lamp in accordance with claim 7 wherein said chemical fill consists essentially of about 10 mg/$cm^3$ mercury; 0.1 mg/$cm^3$ scandium metal; 1 mg/$cm^3$ scandium iodide; 100 mg/$cm^3$ sodium iodide; 4 mg/$cm^3$ lithium iodide; and 100 torr starting gas.

9. A low wattage metal halide discharge lamp in accordance with claim 8 wherein said lamp has a single ended configuration.

10. A low wattage metal halide discharge lamp in accordance with claim 1 wherein said arc tube has a wall loading in the range of about 14 to 17 watts/$cm^2$.

11. A low wattage metal halide discharge lamp in accordance with claim 1 wherein said scandium metal is present in a weight dosage of about 90 to 10 micrograms per cubic centimeter.

12. A low wattage metal halide discharge lamp in accordance with claim 1 wherein said mercury is present in a weight dosage in accordance with the formula: $N(Hg)\ (mg/cm^3)=7.7D^{1/7}$ wherein D is the arc tube diameter in millimeters.

13. A low wattage metal halide discharge lamp comprising:

an outer sealed glass envelope;

a pair of electrical conductors sealed into and passing through the glass envelope;

an arc tube disposed within the outer glass envelope, the arc tube including a pair of spaced electrodes therein with the electrodes being electrically connected to the electrical conductors such that one electrode is electrically connected to one electrical conductor;

a chemical fill disposed within the arc tube, the chemical fill consists essentially of 10 mg/$cm^3$ mercury; 0.1 mg/$cm^3$ sodium iodide; 4 mg/$cm^3$ scandium iodide; 10 mg/$cm^3$ sodium iodide; 4 mg/$cm^3$ lithium iodide; and 100 torr starting gas;

a support structure disposed within the outer glass envelope to support the arc tube therein, the support structure being electrically isolated from the electrical circuit of the lamp; and a radiation shield supported from the support structure such that it surrounds the arc tube.

14. A low wattage metal halide discharge lamp in accordance with claim 13 wherein said lamp has a wattage of 40 to 150 watts.

15. A low wattage metal halide discharge lamp in accordance with claim 14 wherein said arc tube has a wall loading in the range of about 14 to 17 watts/$cm^2$.

16. A low wattage metal halide discharge lamp in accordance with claim 14 wherein said scandium metal is present in a weight dosage of about 90 to 110 micrograms per cubic centimeter.

17. A low wattage metal halide discharge lamp in accordance with claim 14 wherein said mercury is present in a weight dosage in accordance with the formula: $N(Hg)\ (mg/cm^3)=7.7D^{1/7}$ wherein D is the arc tube diameter in millimeters.

* * * * *